US006921444B2

(12) United States Patent
Joaquin et al.

(10) Patent No.: US 6,921,444 B2
(45) Date of Patent: Jul. 26, 2005

(54) METHOD OF LOCALLY HEATING A PART TO REDUCE STRENGTH AND INCREASE DUCTILITY FOR SUBSEQUENT MANUFACTURING OPERATION

(75) Inventors: Armando Mateo Joaquin, Rochester Hills, MI (US); Paul George Sanders, Milan, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 185 days.

(21) Appl. No.: 10/248,351

(22) Filed: Jan. 13, 2003

(65) Prior Publication Data

US 2004/0134573 A1 Jul. 15, 2004

(51) Int. Cl.[7] ..... C21D 8/10; C22F 1/04

(52) U.S. Cl. ..... 148/570; 148/593; 148/627; 148/695; 148/714

(58) Field of Search ..... 148/567, 627, 148/667, 695, 714

(56) References Cited

U.S. PATENT DOCUMENTS 5,492,207 A 2/1996 Clausen
5,527,404 A 6/1996 Warren
5,961,752 A 10/1999 Bergsma
6,322,645 B1 * 11/2001 Dykstra et al. ..... 148/520
6,325,584 B1 12/2001 Marko et al.
6,417,490 B1 7/2002 Liebrecht et al.
6,477,774 B1 * 11/2002 Marando et al. ..... 29/897.2
6,605,370 B2 * 8/2003 Wittebrood et al. ..... 428/652
6,825,442 B2 * 11/2004 Schroth et al. ..... 219/137 WM

* cited by examiner

*Primary Examiner*—George Wyszomierski
(74) *Attorney, Agent, or Firm*—Raymond L. Coppiellie; Brooks & Kushman, P.C.

(57) ABSTRACT

A method of performing manufacturing operations on a workpiece made of a high strength alloy is disclosed in which a local area of a workpiece is heated to micro-structurally soften the local area. The local area of the workpiece becomes softened and more ductile. A manufacturing operation involving deformation of the heat softened area is performed with the metal in the heat softened region being more ductile and having less strength than the surrounding portions thereof. Manufacturing operations may include riveting, clinching, hydro-forming, and magnetic pulse joining.

7 Claims, 1 Drawing Sheet

METHOD OF LOCALLY HEATING A PART TO REDUCE STRENGTH AND INCREASE DUCTILITY FOR SUBSEQUENT MANUFACTURING OPERATION

BACKGROUND OF INVENTION

1. Field of the Invention

The present invention relates to micro-structural softening of a workpiece to improve manufacturing process performance.

2. Background Art

Manufacturing processes involve modification of workpieces and assembling workpieces. New high strength alloys are being implemented in manufacturing operations to take advantage of high strength to weight ratio of such materials. There are many advantages relating to the use of high strength alloy materials but manufacturing problems may arise as a result of difficulties encountered when conventional manufacturing techniques are used with such materials.

Certain manufacturing processes may be adversely impacted when applied to high strength materials. For example, the use of self-piercing rivets, attachment of clinch-type fasteners, hydro-forming, and magnetic pulse joining is more difficult when applied to high strength alloys such as heat treatable aluminum, steel, and magnesium alloys. For example, lightweight aluminum self-piercing rivets are not normally useable with high strength alloys because of the hardness of such materials even though their use would allow for weight savings.

High strength materials are generally more brittle than conventional materials and alloys. Brittle materials may crack during manufacturing processes due to limited ductility and may also suffer from material fatigue.

Manufacturing processes such as hydro-forming are limited when applied to high strength materials. For example, aluminum parts may be deformed to a limited extent in hydro-forming. However, high strength alloys can be deformed to a lesser degree of deformation than annealed alloys.

Another manufacturing process is magnetic pulse welding or joining wherein a magnetic pulse is directed between two parts to join the parts together that may be made of dissimilar materials. The use of high strength alloys in one or both of the materials may make it more difficult or limit the use of magnetic pulse welding in certain manufacturing operations.

The above problems and other problems that are apparent to one or more skilled in the art are addressed by applicant's invention as summarized below.

SUMMARY OF INVENTION

According to one aspect of the present invention, a method of manufacturing a metal workpiece is provided wherein a local area of the workpiece is heated. The workpiece is subsequently loaded into a tool and a force is applied with the tool that plastically deforms the local area that was previously heated in a desired manner. The workpiece is then unloaded from the tool. The metal workpiece may be formed initially of a heat treated high strength alloy material such as aluminum, iron, or magnesium alloy.

According to another aspect of the invention, the local area of the workpiece is heated by induction heating and then cooled before loading into the tool. The tool may be a riveting tool, cinch tool, hydro-forming tool, or magnetic pulse joining tool.

According to another aspect of the invention, a method of riveting a piece of heat treated metal alloy is provided wherein an area of the metal through which a self-piercing rivet is to be inserted is locally heated. The rivet is punched through the heat treated area and an end of the rivet is swagged to secure the rivet in place. The rivet may be punched through the workpiece while the local area is hot or may be punched through after the locally heated area has been cooled.

According to another aspect of the invention, a method of clinching a part to a sheet metal panel is provided. The method comprises heating a localized area of the sheet metal panel, placing the part against the localized area of the sheet metal panel, and forming the metal from the localized area into a recess in the part to attach the part to the sheet metal panel. The sheet metal panel may be a high strength alloy that by heating is softened and is rendered more ductile. The part may be hot or cold.

According to another aspect of the invention, a method of hydro-forming a heat treated metal part is provided. The method comprises locally heating a portion of the metal part, inserting the portion of the metal part into the hydro-forming die, and injecting water under pressure to form a portion of the metal part against the die.

According to another aspect of the invention, a method for magnetic pulse joining first and second metal parts is provided. A local area of the first metal part is heat treated and the first metal part is placed adjacent the second metal part. The first and second metal parts may be nested circular cross-section parts and may be made of different types of metal. A magnetic pulse is applied to the local area of the first metal part deforming the first metal part until it is joined to the second metal part. The part may be hot or cold.

These and other aspects of the present invention will be better understood in view of the attached drawings and following detailed description of several embodiments of the invention.

DETAILED DESCRIPTION

Figure 1:
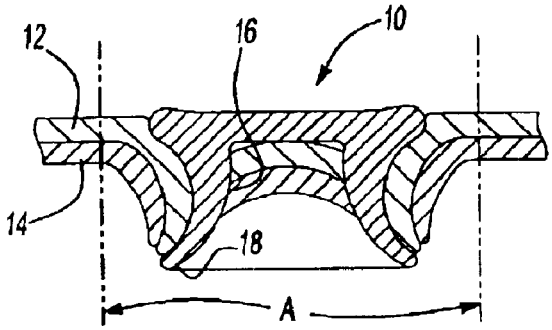
FIG. 1 is a cross-sectional view of two panels joined by a self-piercing rivet.

Referring now to FIG. 1, a self-piercing rivet 10 is shown joining first and second panels 12 and 14 together. The first and second panels 12 and 14 have a local area that is heated between the phantom lines A. The area between the lines A is heated preferably by induction heating or possibly by a flame torch to reduce the strength and increase the ductility of the material in the local area. The self-piercing rivet 10 is then inserted through the first and second panels 12 and 14 piercing them to form a hole 16 as the self-piercing rivet 10 is driven through the first and second panels 12 and 14. A swagged end 18 is formed to lock the panels together.

Figure 2:
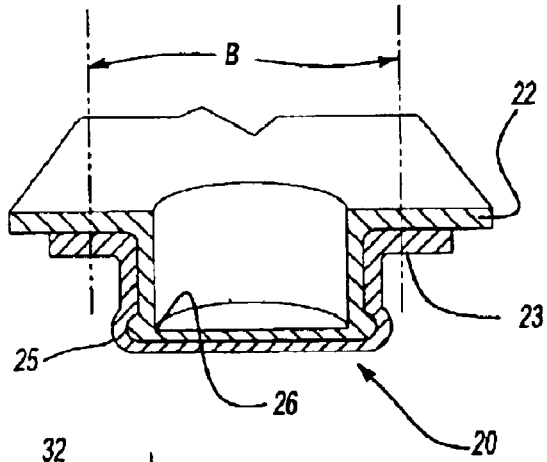
FIG. 2 is a cross-sectional view showing a clinch joint for attaching a part to a metal panel.

Referring now to FIG. 2, a clinch joint 20 is shown for securing two panels 22, 23, or two parts together. The clinch joint is formed in the panels 22, 23. One or both of the panels

22, 23 are heated in a local area surrounding the clinch joint 20 generally between phantom lines B. During the clinch assembly process, interlocking portions 25,26 are deformed to lock the panels together. A similar clinching process may also be applied to assemble a clinch nut to a panel.

Figure 3:
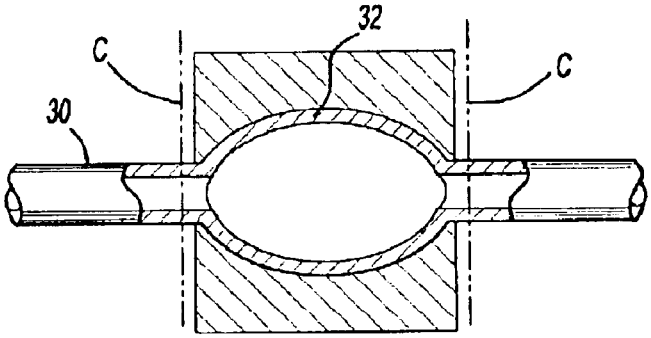
FIG. 3 is a cross-sectional view showing a hydro-formed workpiece.

Referring now to FIG. 3, a hydro-formed part is shown to include a tube 30 having an expanded section 32. The portion of the tube 30 between the phantom lines C is locally heated prior to the hydro-forming operation that forms the expanded section 32. By heating between the phantom lines C, the micro-structure of the metal forming the tube 30 is softened and is increased in ductility. In this way it is believed that hydro-forming in the localized area may be increased.

Figure 4:
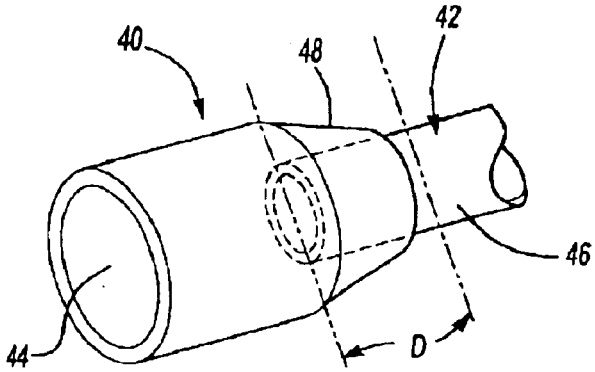
FIG. 4 is a partial cross-sectional perspective view of two tubing sections joined by a magnetic pulse joint.

Referring now to FIG. 4, first and second tubes 40, 42 are shown joined together in a magnetic pulse joining process. An inner surface 44 of the first tube 40 and an outer surface 46 of the second tube 42 are preferably held in a spaced, nested relationship prior to the magnetic pulse joining operation. A magnetic pulse joint 48 is formed in a local area defined between the phantom lines D. The local area is softened by heating prior to the magnetic pulse joining operation. By heating the area to be joined by the magnetic pulse joint 48, a greater degree of deformation may be realized or a higher strength tube may be joined. The outer tube 40 may be collapsed inwardly to a limited extent as shown or the inner tube 42 may be expanded to form the magnetic pulse joint.

While the best mode for carrying out the invention has been described in detail, those familiar with the art to which this invention relates will recognize various alternative designs and embodiments for practicing the invention as defined by the following claims.

What is claimed is:

1. A method of manufacturing a high strength, heat treated metal alloy tube, comprising:

heating a local area of the tube in a focused manner to increase the ductility of only the local area without softening other portions of the tube;

loading the tube into a hydro-forming tool;

applying a force primarily to the local area with the hydro-forming tool that plastically deforms the local area in a desired manner; and unloading the tube from the hydro-forming tool.

2. The method of claim 1 wherein the tube is cooled before loading in the hydro-forming tool.

3. The method of claim 1 wherein the tube is hot when loaded into the hydro-forming tool.

4. The method of claim 1 wherein the local area of tube is heated by induction heating.

5. A method of hydro-forming a unitary metal part that has been heat treated to harden the part comprising:

locally heating a first portion of the part to micro-structurally soften the first portion while not heating that portion that retains its hardness;

inserting the metal part into a hydro-forming die; and injecting water under pressure to form the first portion of the metal part in the hydro-forming die.

6. The method of claim 5 wherein the first portion of the metal part is placed in the die when the first portion of the metal part is hot.

7. The method of claim 5 wherein the first portion of the metal part is placed in the die when the first portion of the metal part is cold.

* * * * *